US005413697A

United States Patent [19]

Fletcher et al.

[11] Patent Number: 5,413,697

[45] Date of Patent: May 9, 1995

[54] GASOLINE UPGRADING PROCESS

[75] Inventors: David L. Fletcher, Turnersville; Michael S. Sarli, Haddonfield; Stuart S. Shih, Cherry Hill, all of N.J.

[73] Assignee: Mobil Oil Corporation, Fairfax, Va.

[21] Appl. No.: 913,326

[22] Filed: Jul. 15, 1992

Related U.S. Application Data

[63] Continuation-in-part of Ser. No. 850,106, Mar. 12, 1992, which is a continuation-in-part of Ser. No. 745,311, Aug. 15, 1991, Pat. No. 5,346,609.

[51] Int. Cl.[6] ..... C10G 69/02

[52] U.S. Cl. ..... 208/89; 208/58; 208/211; 208/213

[58] Field of Search ..... 208/89, 58, 211, 213

[56] References Cited

U.S. PATENT DOCUMENTS

| | | | |
|---|---|---|---|
| 3,729,409 | 8/1973 | Chen | 208/135 |
| 3,758,403 | 9/1973 | Rosinshi | 208/111 |
| 3,759,821 | 9/1973 | Brennan | 208/93 |
| 3,767,568 | 10/1973 | Chen | 208/132 |
| 3,894,931 | 7/1975 | Nace | 208/73 |
| 3,957,625 | 5/1976 | Orkin | 208/211 |
| 4,049,542 | 9/1977 | Gibson | 208/213 |
| 4,062,762 | 12/1977 | Howard | 208/211 |
| 4,309,280 | 1/1982 | Rosinski et al. | 208/120 |
| 4,368,114 | 1/1983 | Chester et al. | 208/120 |
| 4,740,292 | 4/1988 | Chen et al. | 208/120 |
| 4,827,076 | 5/1989 | Kokayeff et al. | 208/213 |
| 4,911,823 | 3/1990 | Chen et al. | 208/49 |
| 4,992,606 | 2/1991 | Kushnerich et al. | 385/467 |
| 5,143,596 | 9/1992 | Maxwell et al. | 208/89 |

*Primary Examiner*—Helane Myers
*Attorney, Agent, or Firm*—Alexander J. McKillop; Malcolm D. Keen; Jessica M. Sinnott

[57] ABSTRACT

Low sulfur gasoline of relatively high octane number is produced from a catalytically cracked, sulfur-containing naphtha by hydrodesulfurization followed by treatment over an acidic catalyst containing, preferably an intermediate pore size zeolite such as ZSM-5 and a zeolite such as MCM-22. The treatment over the acidic catalyst in the second step restores the octane loss which takes place as a result of the hydrogenative treatment and results in a low sulfur gasoline product with an octane number comparable to that of the feed naphtha. In favorable cases, using feeds of extended end point such as heavy naphthas with 95 percent points above about 380° F. (about 193° C.), improvements in both product octane and yield relative to the feed may be obtained.

20 Claims, No Drawings

GASOLINE UPGRADING PROCESS

CROSS REFERENCE TO RELATED APPLICATIONS

This application is a continuation-in-part of our prior application Ser. No. 07/850,106, filed on Mar. 12, 1992, which is a continuation-in-part of Ser. No. 07/745,311, filed on Aug. 15, 1991, now U.S. Pat. No. 5,346,609, issued on Sep. 13, 1994, which are both incorporated herein by reference in their entireties.

This application is related to application Ser. No. 07/930,589, filed on Aug. 17, 1992, now abandoned and Ser. No. 07/949,926, filed on Sep. 24, 1993.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Catalytically cracked gasoline forms a major part of the gasoline product pool in the United States. It is conventional to recover the product of catalytic cracking and to fractionate the product into various fractions such as light gases; naphtha, including light and heavy gasoline; distillate fractions, such as heating oil and Diesel fuel; lube oil base fractions; and heavier fractions.

A large proportion of the sulfur in gasoline results from the catalytically cracked gasoline component due to the sulfur content of the petroleum fractions being catalytically cracked. The sulfur impurities may require removal, usually by hydrotreating, in order to comply with product specifications or to ensure compliance with environmental regulations both of which are expected to become more stringent in the future, possibly permitting no more than about 300 ppmw sulfur in motor gasolines. Low sulfur levels result in reduced emissions of CO, $NO_x$ and hydrocarbons.

In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After completion of hydrotreating, the product may be fractionated, or flashed, to release the hydrogen sulfide and collect the sweetened gasoline.

However, cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Proposals have been made for removing sulfur impurities while retaining the high octane contributed by the olefins. Since the sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. Alternatively, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Other processes for enhancing the octane rating of catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

Other methods have been proposed for increasing the octane number of the gasoline pool. Naphthas, including light and full range naphthas, may be subjected to catalytic reforming so as to increase their octane numbers by converting at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute a substantial volume to the gasoline pool, but they do not generally contribute significantly to higher octane values without reforming.

We have demonstrated in our prior applications Ser. No. 07/850,106, filed on Mar. 12, 1992, now U.S. Pat. No. 5,346,609, and Ser. No. 07/745,311, filed on Aug. 15, 1991, that zeolite ZSM-5 is effective for restoring the octane loss which takes place when the initial naphtha feed is hydrotreated. When the hydrotreated naphtha is passed over the catalyst in the second step of the process, some components of the gasoline are cracked into lower boiling range materials. If these boil below the gasoline boiling range, there will be a loss in the yield of the gasoline product. However, if the cracking products are within the gasoline boiling range, an increase occurs in the net volumetric yield. To achieve this, it is helpful to increase the end point of the naphtha feed to the extent that this will not result in exceeding the gasoline product end point, or similar restrictions (e.g. $T_{90}$, $T_{95}$).

Catalysts containing combinations of zeolites have been proposed for the catalytic cracking of petroleum fractions. These combined zeolite catalyst systems have demonstrated improvements in the octane number and overall yield of products of catalytic cracking as described in U.S. Pat. No. 3,758,403. There, a catalyst comprising a large pore size crystalline zeolite (pore size greater than 7 Angstrom units) in admixture with ZSM-5 is utilized as the cracking catalyst. The use of varying amounts of a ZSM-5 zeolite in combination with a larger pore material, specifically an X or Y zeolite cracking catalyst is described in U.S. Pat. Nos. 3,769,202; 3,894,931; 3,894,933; 3,894,934 and 4,309,280. In U.S. Pat. No. 4,911,823 a cracking catalyst comprising a combination of zeolite beta and another zeolite such as an intermediate pore size zeolite, i.e. ZSM-5, is described for improvement in the octane number of cracked naphtha products. The use of a catalyst composition comprising zeolite beta and one or more faujasite-type zeolites in catalytic cracking is described in U.S. Pat. No. 4,740,292. The patent discloses improved octane and increased gasoline plus alkylate yield relative to the conventional faujasite-type cracking catalyst used alone.

However, as previously pointed out, the catalytically cracked products still contain high levels of sulfur impurities. Thus, the tension between octane depletion and hydrodesulfurization, remains.

SUMMARY OF THE INVENTION

We have now developed an improved process for catalytically desulfurizing cracked fractions in the gasoline boiling range which enables the sulfur to be reduced to acceptable levels without substantially reducing the octane number. We discovered that a catalyst which includes a combination of an intermediate pore size zeolite and at least one of a class of synthetic porous crystalline materials exemplified by MCM-22 is beneficial in the gasoline upgrading process.

The catalyst system containing at least two different cracking components takes advantage of each component which contributes a distinct process advantage. A cracking component which contributes a substantial octane increase is combined with a cracking component that contributes improved back-end cracking selectivity. In addition, the production of increased branched-chain $C_4$ and $C_5$ paraffins and olefins which are expected from the synthetic porous crystalline materials exemplified by MCM-22 are useful in alkylation and etherification units for the production of alkylate and fuel ethers such as methyltertbutyl ether (MTBE) and tertamylmethyl ether (TAME).

According to this invention, a sulfur-containing cracked petroleum fraction in the gasoline boiling range is hydrotreated, in a first step, under conditions which remove at least a substantial proportion of the sulfur. The hydrotreated intermediate product is then treated, in a second step, by contact with a catalyst system of acidic functionality which comprises a combination of an intermediate pore size aluminosilicate zeolite having the topology of ZSM-5 and at least one of a class of synthetic porous crystalline materials exemplified by MCM-22.

The synthetic porous crystalline materials exemplified by MCM-22 are characterized by an X-ray diffraction pattern including interplanar d-spacings at 12.36±0.4, 11.03±0.2, 8.83±0.14, 6.18±0.12, 6.00±0.10, 4.06±0.07, 3.91±0.07 and 3.42±0.06 Angstroms under conditions which convert the hydrotreated intermediate product fraction to a fraction in the gasoline boiling range of higher octane value.

The invention is more closely directed to a process of upgrading a sulfur-containing feed fraction boiling in the gasoline boiling range which comprises:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst system having acidic functionality which comprises a zeolite having the topology of ZSM-5 and a synthetic porous crystalline material characterized by an X-ray diffraction pattern including interplanar d-spacings at 12.36±0.4, 11.03±0.2, 8.83±0.14, 6.18±0.12, 6.00±0.10, 4.06±0.07, 3.91±0.07 and 3.42±0.06 Angstroms The process may be utilized to desulfurize light and full range naphtha fractions while maintaining octane so as to obviate the need for reforming such fractions, or at least, without the necessity of reforming such fractions to the degree previously considered necessary. Since reforming generally implies a significant yield loss, this constitutes a marked advantage.

DETAILED DESCRIPTION

Feed

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

An example of a heavy cracked naphtha which can be subjected to processing as described herein may have the properties set out in Table 1 below.

TABLE 1

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, ASTM D-2887, | °F./°C. |
| 5% | 289/143 |
| 10% | 355/179 |
| 30% | 405/207 |
| 50% | 435/223 |
| 70% | 455/235 |
| 90% | 482/250 |
| 95% | 488/253 |

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

This hydrotreated intermediate product which also boils in the gasoline boiling range (and usually has a boiling range which is not substantially higher than the boiling range of the feed), is then treated by contact with an acidic catalyst under conditions which produce a second product comprising a fraction which boils in the gasoline boiling range which has a higher octane number than the portion of the hydrotreated intermediate product fed to this second step. The product from this second step usually has a boiling range which is not substantially higher than the boiling range of the feed to the hydrotreater, but it is of lower sulfur content while having a comparable octane rating as the result of the second step treatment.

Hydrotreating

The temperature of the hydrotreating step is suitably from about 400° to 850° F. (about 220° to 454° C.), preferably about 500° to 800° F. (about 260° to 427° C) with the exact selection dependent on the desulfurization desired for a given feed and catalyst. Because the hydrogenation reactions which take place in this step are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.) The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5+$) materials may occur.

Octane Restoration—Second Step Processing

After the hydrotreating step, the hydrotreated intermediate product is passed to the second step of the process in which cracking takes place in the presence of the acidic functioning catalyst. The effluent from the hydrotreating step may be subjected to an interstage separation in order to remove the inorganic sulfur and nitrogen as hydrogen sulfide and ammonia as well as light ends but this is not necessary and, in fact, it has been found that the first step can be cascaded directly into the second step. This can be done very conveniently in a down-flow, fixed-bed reactor by loading the hydrotreating catalyst directly on top of the second step catalyst.

The separation of the light ends at this point may be desirable if the added complication is acceptable since the saturated $C_4$–$C_6$fraction from the hydrotreater is a highly suitable feed to be sent to the isomerizer for conversion to iso-paraffinic materials of high octane rating; this will avoid the conversion of this fraction to non-gasoline ($C_5-$) products in the second step of the process. Another process configuration with potential advantages is to take a heart cut, for example, a 195°–302° F. (90°–150° C.) fraction, from the first step product and send it to the reformer where the low octane naphthenes which make up a significant portion of this fraction are converted to high octane aromatics. The heavy portion of the first step effluent is, however, sent to the second step for restoration of lost octane by treatment with the acid catalyst. The hydrotreatment in the first step is effective to desulfurize and denitrogenate the catalytically cracked naphtha which permits the heart cut to be processed in the reformer. Thus, the preferred configuration in this alternative is for the second step to process the $C_8+$ portion of the first step effluent and with feeds which contain significant amounts of heavy components up to about $C_{13}$ e.g. with $C_9$–$C_{13}$ fractions going to the second step, improvements in both octane and yield can be expected.

The conditions used in the second step are those which are appropriate to produce this controlled degree of cracking. Typically, the temperature of the second step will be about 300° to 900° F. (about 150° to 480° C.), preferably about 350° to 800 ° F. (about 177° C. to 146° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the Constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range (C5−) during the second step is held to a minimum. However, because the cracking of the heavier portions of the feed may lead to the production of products still within the gasoline range, a net increase in C5+ material may occur during this step of the process, particularly if the feed includes significant amounts of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose contain a combination of the intermediate pore size zeolitic behaving catalytic materials which are exemplified by those acid acting materials having the topology of intermediate pore size aluminosilicate zeolites and zeolitic materials exemplified by MCM-22.

The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The catalyst used in the second step of the process suitably has an alpha activity of at least about 20, usually in the range of 20 to 800 and preferably at least about 50 to 200. The acid activity of this catalyst should not be too high because it is desirable to only crack and rearrange so much of the intermediate product as is necessary to restore lost octane without severely reducing the volume of the gasoline boiling range product.

The acidic catalyst is a catalyst system comprised of a combination of an intermediate pore size zeolite and synthetic porous crystalline material exemplified by MCM-22 which is characterized by an X-ray diffraction pattern including interplanar d-spacings at 12.36±0.4, 11.03±0.2, 8.83±0.14, 6.18±0.12, 6.00±0.10, 4.06±0.07, 3.91±0.07 and 3.42±0.06 Angstroms.

The preferred intermediate pore size zeolite has a Constraint Index ranging from about 2 to 12, preferably 8 to 10, specifically about 8.3. Reference is here made to U.S. Pat. No. 4,784,745 for a definition of Constraint Index and a description of how this value is measured. The particularly preferred intermediate pore size zeolite component has the topology of ZSM-5 which is described in U.S. Pat. No. 3,702,886 and reference should be made thereto for a complete description of ZSM-5.

The other component of the catalyst is a porous crystalline material exemplified by MCM-22. This material is described in U.S. Pat. Nos. 4,962,256; 4,992,606 and 4,954,325 to which reference is made for a description of this zeolite, its properties and its preparation. This material may be defined by reference to its X-Ray diffraction patterns, as set out below.

In its calcined form, the synthetic porous crystalline component of the catalyst is characterized by an X-ray diffraction pattern including the lines shown in Table 1 below:

TABLE 1

| Interplanar d-Spacing (A) | Relative Intensity, $I/I_o \times 100$ |
|---|---|
| 12.36 ± 0.4 | M-VS |
| 11.03 ± 0.2 | M-S |
| 8.83 ± 0.14 | M-VS |
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS |

More specifically, it may be characterized by an X-ray diffraction pattern in its calcined form including the following lines shown in Table 2 below:

TABLE 2

| Interplanar d-Spacing (A) | Relative Intensity, $I/I_o \times 100$ |
|---|---|
| 30.0 ± 2.2 | W-M |
| 22.1 ± 1.3 | W |
| 12.36 ± 0.4 | M-VS |
| 11.03 ± 0.2 | M-S |
| 8.83 ± 0.14 | M-VS |
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS |

More specifically, the calcined form may be characterized by an X-ray diffraction pattern including the following lines shown in Table 3 below:

TABLE 3

| Interplanar d-Spacing (A) | Relative Intensity, $I/I_o \times 100$ |
|---|---|
| 12.36 ± 0.4 | M-VS |
| 11.30 ± 0.2 | M-S |
| 8.83 ± 0.14 | M-VS |
| 6.86 ± 0.14 | W-M |
| 6.18 ± 0.12 | M-VS |
| 6.00 ± 0.10 | W-M |
| 5.54 ± 0.10 | W-M |
| 4.92 ± 0.09 | W |
| 4.64 ± 0.08 | W |
| 4.41 ± 0.08 | W-M |
| 4.25 ± 0.08 | W |
| 4.10 ± 0.07 | W-S |
| 4.06 ± 0.07 | W-S |
| 3.91 ± 0.07 | M-VS |
| 3.75 ± 0.06 | W-M |
| 3.56 ± 0.06 | W-M |
| 3.42 ± 0.06 | VS |
| 3.30 ± 0.05 | W-M |
| 3.20 ± 0.05 | W-M |
| 3.14 ± 0.05 | W-M |
| 3.07 ± 0.05 | W |
| 2.99 ± 0.05 | W |
| 2.82 ± 0.05 | W |
| 2.78 ± 0.05 | W |
| 2.68 ± 0.05 | W |
| 2.59 ± 0.05 | W |

Most specifically, it may be characterized in its calcined form by an X-ray diffraction pattern including the following lines shown in Table 4 below:

TABLE 4

| Interplanar d-Spacing (A) | Relative Intensity, $I/I_o \times 100$ |
|---|---|
| 30.0 ± 2.2 | W-M |
| 22.1 ± 1.3 | W |
| 12.36 ± 0.4 | M-VS |
| 11.30 ± 0.2 | M-S |
| 8.83 ± 0.14 | M-VS |
| 6.86 ± 0.14 | W-M |
| 6.18 ± 0.12 | M-VS |
| 6.00 ± 0.10 | W-M |
| 5.54 ± 0.10 | W-M |
| 4.92 ± 0.09 | W |
| 4.64 ± 0.08 | W |
| 4.41 ± 0.08 | W-M |
| 4.25 ± 0.08 | W |
| 4.10 ± 0.07 | W-S |
| 4.06 ± 0.07 | W-S |
| 3.91 ± 0.07 | M-VS |
| 3.75 ± 0.06 | W-M |
| 3.56 ± 0.06 | W-M |
| 3.42 ± 0.06 | VS |
| 3.30 ± 0.05 | W-M |
| 3.20 ± 0.05 | W-M |
| 3.14 ± 0.05 | W-M |
| 3.07 ± 0.05 | W |
| 2.99 ± 0.05 | W |
| 2.82 ± 0.05 | W |
| 2.78 ± 0.05 | W |
| 2.68 ± 0.05 | W |
| 2.59 ± 0.05 | W |

The values of the d-spacing and relative intensity are determined by standard techniques, as described in U.S. Pat. No. 4,954,325.

Examples of porous crystalline materials conforming to these structural types manifesting themselves in the characteristic X-ray diffraction patterns include the PSH-3 composition of U.S. Pat. No. 4,439,409, to which reference is made for a description of this material as well as of its preparation. Another crystalline material of this type is the preferred MCM-22.

Zeolite MCM-22 has a chemical composition expressed by the molar relationship:

$$X_2O_3:(n)YO_2,$$

where X is a trivalent element, such as aluminum, boron, iron and/or gallium, preferably aluminum, Y is a tetravalent element such as silicon and/or germanium, preferably silicon, and n is at least about 10, usually from about 10 to about 150, more usually from about 10 to about 60, and even more usually from about 20 to about 40. In the as-synthesized form, MCM-22 has a formula, on an anhydrous basis and in terms of moles of oxides per n moles of $YO_2$, as follows:

$$(0.005\text{–}0.1)Na_2O:(1\text{–}4)R:X_2O_3:nYO_2$$

where R is an organic component. The Na and R components are associated with the zeolite as a result of their presence during crystallization, and are easily removed by the post-crystallization methods described in U.S. Pat. No. 4,954,325.

MCM-22 is thermally stable and exhibits a high surface area greater than about 400 $m^2/gm$ as measured by the BET (Bruenauer, Emmet and Teller) test and unusually large sorption capacity when compared to previously described crystal structures having similar X-ray diffraction patterns. As is evident from the above formula, MCM-22 is synthesized nearly free of Na cations and thus possesses acid catalysis activity as synthesized. It can, therefore, be used as a component of the catalyst without having to first undergo an exchange step. To the extent desired, however, the original sodium cations of the as-synthesized material can be replaced by established techniques including ion exchange with other cations. Preferred replacement cations include metal ions, hydrogen ions, hydrogen precursor ions, e.g., ammonium and mixtures of such ions.

In its calcined form, MCM-22 appears to be made up of a single crystal phase with little or no detectable impurity crystal phases and has an X-ray diffraction pattern including the lines listed in above Tables 1–4.

Prior to its use as the catalyst in the present process, the crystals should be subjected to thermal treatment to remove part or all of any organic constituent present in the as-synthesised material.

The zeolite, in its as-synthesised form which contains organic cations as well as when it is in its ammonium form, can be converted to another form by thermal treatment. This thermal treatment is generally performed by heating one of these forms at a temperature of at least about 370° C. for at least 1 minute and generally not longer than 20 hours. While subatmospheric pressure can be employed for the thermal treatment, atmospheric pressure is preferred simply for reasons of convenience. The thermal treatment can be performed at a temperature of up to a limit imposed by the irreversible thermal degradation of the crystalline structure of the zeolite.

Prior to its use in the process, the zeolite crystals should be dehydrated, at least partially. This can be done by heating the crystals to a temperature in the range of from about 200° to about 595° C. in an atmosphere such as air, nitrogen, etc. and at atmospheric, subatmospheric or superatmospheric pressures for between about 30 minutes to about 48 hours. Dehydration can also be performed at room temperature merely by placing the crystalline material in a vacuum, but a longer time is required to obtain a sufficient amount of dehydration.

As previously stated, another component of the catalyst of this invention is a zeolite having the topology of ZSM-5. There are many methods for synthesizing ZSM-5 which have been described. The ZSM-5 zeolite used in the invention usually will have the original cations associated therewith replaced by a wide variety of other cations according to techniques well known in the art. Typical replacing cations would include hydrogen, ammonium and metal cations including mixtures of the same.

Typical ion exchange techniques would be to contact the particular zeolite with a salt of the desired replacing cation or cations. Although a wide variety of salts can be employed, particular preference is given to chlorides, nitrates and sulfates.

Prior to use, the zeolites should be dehydrated at least partially. This can be done by heating to a temperature in the range of 440° F. to 1100° F. in an air or an inert atmosphere, such as nitrogen for 1 to 48 hours. Dehydration can also be performed at lower temperatures by using a vacuum, but a longer time is required to obtain a sufficient amount of dehydration.

It is also possible to treat the zeolite with steam at elevated temperatures ranging from 800° F. to 1600° F. and treatment may be accomplished in atmospheres consisting partially or entirely of steam.

A preferred embodiment of the invention employs the use of a binder or substrate into which the zeolites are incorporated because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The zeolite materials are exemplary of the topology and pore structure of suitable acid-acting refractory solids. A useful catalyst system is not confined, however, to the aluminosilicate versions and other refractory solid materials which are characterized by the above-described acid activity, pore structure and topology may be used. The zeolite designations referred to above, for example define the topology only and do not restrict the compositions of the zeolitic-behaving catalyst components.

The zeolites are combined in the catalyst in amounts which may vary depending upon the preferred product composition. The ZSM-5 component facilitates production of high octane products while the MCM-22 component adds increased conversion of the higher boiling components and conversion to materials suitable as feed to alkylation or for making oxygenates such as MTBE and TAME. Thus, it is appropriate to vary the amount of each zeolite depending upon the preferred product composition.

The catalyst system of the invention contains a ratio of zeolite having the topology of zeolite beta to zeolite having the topology of ZSM-5 ranging from 0.1:10 to 10:1.

Thus, the zeolites can be present in about equal amounts in order to achieve a balance in the properties that each will contribute to the overall process. However, the relative proportion of the ZSM-5 component can be lower than the MCM-22 component such that it is used in additive amounts. That is, based on the MCM-22 component, the ZSM-5 component can be used in lower amounts, for example, less than 50 wt. %, preferably from about 5 wt. % to about 40 wt. % and more, preferably from about 15 wt. % to about 30 wt. %. If a higher proportion of the more selective ZSM-5 component is preferred, then, less than about 50 wt. % of the MCM-22, preferably ranging from about 5 wt. % to about 40 wt. %, preferably from about 15 wt. % to about 30 wt. % can be used.

The catalyst system can comprise a physical mixture of the zeolite components. The catalyst composite can be prepared by mechanically mixing together the two zeolites to produce a catalyst composition which comprises a mixture of discrete crystallites of the zeolites, or zeolite behaving materials. The zeolites can be mixed and then a suitable hydrogenation-dehydrogenation component can be deposited on at least one of them by conventional impregnation techniques, either before, after or during mixing. Alternatively, the catalyst can be a single extrudate catalyst containing the two zeolites.

The zeolites will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina, titania and zirconia.

Both zeolite components need not be mixed with the same matrix. Each can be incorporated into its own separate binder and the ZSM-5-containing composite material can be blended with the MCM-22-containing composite material. The catalyst composites can be used in a physical mixture in the bed or the catalyst bed can be made of layers of each catalyst composite.

The preferred catalyst is HZSM-5 or NiZSM-5/$Al_2O_3$ (65/35 wt %) and unsteamed MCM-22/$Al_2O_3$ (65/35 wt %).

The octane efficiency of the process; that is, the octane gain relative to the yield loss will vary according to a number of factors, including the nature of the feedstock, the conversion level and the relative proportions and activities of the catalysts. It may be useful to vary the amount of each zeolite distributed throughout the bed.

As stated previously, the catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions. If found to be desirable under the actual conditions used with particular feeds, metals such as the Group VIII base metals or combinations will normally be found suitable, for example nickel platinum or palladium. The metal component will vary depending upon the preferred performance. Usually this is incorporated with the ZSM-5 component. The amount can range from 0.05 to 1.0 wt %, preferably 0.1 to 0.8 wt % based on the entire weight of the catalyst composite.

The particle size and the nature of the second conversion catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process, as noted above, with the fixed-bed type of operation preferred.

PRODUCT OPTIMIZATION

The conditions of operation and the catalyst proportion should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of the product) of the product will be higher than the octane barrels of the feed.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the second step of the process are particularly suitable for this purpose since they are more olefinic than the comparable but saturated fraction from the hydrotreating step. Alternativley, the olefinic light ends from the second step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In the operation of this process, it is reasonable to expect that, with a heavy cracked naphtha feed, the first step hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the sulfur content is high in the feed, that this octane reduction could go as high as about 15%.

The second step of the process should be operated under a combination of conditions such that at least about half (½) of the octane lost in the first step operation will be recovered, preferably such that all of the lost octane will be recovered, most preferably that the second step will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

EXAMPLE

These evaluations and the catalysts used are similar to those described for the HDS/ZSM-5 and HDS/MCM-22 studies of appliction Ser. No. 07/745,311 of Aug. 5, 1992. The tests are conducted in an isothermal pilot plant with both reaction zones at the same temperature (700° F., 370° C.) and $H_2$ pressure (600 psig, 4240 kPa). A Co-Mo/$Al_2O_3$ hydrotreating catalyst is used but the second stage catalysts are MCM-22 and/or ZSM-5. The ZSM-5 catalyst is prepared from a steamed ZSM-5 and the MCM-22 catalyst from unsteamed H-MCM-22 with alumina binder, in each case. The properties of each catalyst are described in Table 1. The feeds are heavy catalytically cracked gasolines. The properties of each are shown in Table 2.

TABLE 1

| Catalyst Properties | | |
|---|---|---|
| Zeolite | MCM-22 | ZSM-5 |
| Steamed | No | Yes |
| Alpha Value | 260 | 110 |
| Zeolite, wt % | 65 | 65 |
| Alumina | 35 | 35 |
| Physical Properties | | |
| Particle Density, g/cc | 0.80 | 0.98 |
| Real Density, cc/g | 2.59 | — |
| Surface Area, $m^2g$ | 335 | 336 |
| Pore Volume, cc/g | 0.86 | 0.65 |
| Average Pore Diameter, A | 103 | 77 |

TABLE 2

| Heavy FCC Naphtha | | |
|---|---|---|
| | HDS/MCM-22 | HDS/ZSM-5 |
| H, wt % | 10.64 | 10.23 |
| S, wt % | 1.45 | 2.0 |
| N, ppmw | 170 | 190 |
| Bromine No. | 11.7 | 14.2 |
| Paraffins, vol % | 24.3 | 26.5 |
| Research Octane | 94.3 | 95.6 |
| Motor Octane | 82.8 | 81.2 |
| Distillation, D2887 (F) | | |
| 5% | 284 | 289 |
| 30% | 396 | 405 |
| 50% | 427 | 435 |
| 70% | 451 | 453 |
| 95% | 492 | 488 |

A catalyst system containing a combiantion of ZSM-5 and MCM-22, as described above, is evaluated. The catalysts contain ZSM-5 (70%)/MCM-22 (30%) and ZSM-5 (30%)/MCM-22 (70%). The predicted results for the integrated catalyst are presented below in Table 3 together with the actual results achieved with the individual ZSM-5 and MCM-22 catalysts.

TABLE 3

| Performance Comparison | | | | |
|---|---|---|---|---|
| Zeolite Catalyst Composition | Run 3 | Run 4 | Run 5 | Run 6 |
| ZSM-5 catalyst | 100% | 0% | 70% | 30% |
| MCM-22 Catalyst | 0% | 100% | 30% | 70% |
| Performance Gasoline | | | | |
| Gasoline Octane, R + O | 98.6 | 94.2 | 96.0 | 95.0 |
| $C_5$-330° F. Yield, wt % | 17.9 | 19.0 | 18.2 | 18.7 |

TABLE 3-continued

| Zeolite Catalyst Composition | Performance Comparison Run 3 | Run 4 | Run 5 | Run 6 |
|---|---|---|---|---|
| $C_5$-420° F. Yield, wt % | 50.2 | 57.0 | 52.2 | 55.0 |
| Olefins and Branched Paraffins | | | | |
| $C_3^=$, wt % | 0.22 | 0.14 | 0.20 | 0.16 |
| $C_4^=$, wt % | 0.51 | 1.10 | 0.69 | 0.92 |
| $C_5^=$, wt % | 0.47 | 0.93 | 0.61 | 0.79 |
| Branched $C_4$, wt % | 1.00 | 1.21 | 1.06 | 1.15 |
| Branched $C_5$, wt % | 0.86 | 1.90 | 1.17 | 0.83 |

As Table 3 shows, comparing the MCM-22 catalyst and integrated ZSM-5/MCM-22 catalyst system, the MCM-22 and integrated MCM-22/ZSM-5 catalysts produced more lighter gasolines ($C_5$-330° F. or $C_5$-420° F.) and less 420° C.+ bottoms than ZSM-5. In addition, the integrated catalyst produced more light olefins and branched light paraffins which can be upgraded into high-octane gasoline by conventional alkylation than ZSM-5. Also, the combined catalysts imparted an octane boost over MCM-22 used alone.

We claim:

1. A process of upgrading a sulfur-containing feed fraction boiling in the gasoline boiling range which comprises:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with an acidic catalyst comprising a first synthetic porous crystalline material which is an intermediate pore material and a second synthetic porous crystalline material which is characterized by an X-ray diffraction pattern with the following lines

| Interplanar d-Spacing (A) | Relative Intensity, $I/I_o \times 100$ |
|---|---|
| 12.36 ± 0.4 | M-VS |
| 11.03 ± 0.2 | M-S |
| 8.83 ± 0.14 | M-VS |
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS |

to convert it to a product comprising a fraction boiling in the gasoline boiling range having a higher octane number than the gasoline boiling range fraction of the intermediate product.

2. A process according to claim 1 in which the porous crystalline material has an X-ray diffraction pattern including the following lines:

| Interplanar d-Spacing (A) | Relative Intensity, $I/I_o \times 100$ |
|---|---|
| 30.0 ± 2.2 | W-M |
| 22.1 ± 1.3 | W |
| 12.36 ± 0.4 | M-VS |
| 11.03 ± 0.2 | M-S |
| 8.83 ± 0.14 | M-VS |
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS. |

3. A process according to claim 1 in which the second synthetic porous crystalline material comprises MCM-22.

4. A process according to claim 1 in which the intermediate pore size material has the topology of ZSM-5.

5. The process as claimed in claim 1 in which said feed fraction comprises a light naphtha fraction having a boiling range within the range of $C_6$ to 330° F.

6. The process as claimed in claim 1 in which said feed fraction comprises a full range naphtha fraction having a boiling range within the range of $C_5$ to 420° F.

7. The process as claimed in claim 1 in which said feed fraction comprises a heavy naphtha fraction having a boiling range within the range of 330° to 500° F.

8. The process as claimed in claim 1 in which said feed fraction comprises a heavy naphtha fraction having a boiling range within the range of 330° to 412° F.

9. The process as claimed in claim 1 in which said feed fraction comprises a naphtha fraction having a 95 percent point of at least about 350° F.

10. The process as claimed in claim 9 in which said feed fraction comprises a naphtha fraction having a 95 percent point of at least about 380° F.

11. The process as claimed in claim 10 in which said feed fraction comprises a naphtha fraction having a 95 percent point of at least about 400° F.

12. The process as claimed in claim 1 in which the second porous crystalline material comprises MCM-22 in the aluminosilicate form.

13. The process as claimed in claim 1 in which the first porous crystalline material comprises ZSM-5 in the aluminosilicate form.

14. The process as claimed in claim 1 which is carried out in two stages with an interstage separation of light ends and heavy ends with the heavy ends fed to the second reaction zone.

15. The process as claimed in claim 1 in which the ratio of first synthetic porous crystalline material to second synthetic porous crystalline material ranges from 0.1:1 to 10:1.

16. A process of upgrading a sulfur-containing feed fraction boiling in the gasoline boiling range which comprises:

hydrodesulfurizing a catalytically cracked, olefinic, sulfur-containing gasoline feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in an octane restoring zone with a catalyst of acidic functionality comprising the aluminosilicate form of a zeolite having the topology of ZSM-5 and a zeolite having the topology of MCM-22 to convert it to a product comprising a fraction boiling in the gasoline boiling range having a higher octane number than the gasoline boiling range fraction of the intermediate product.

17. The process as claimed in claim 16 in which the feed fraction has a 95 percent point of at least 350° F., an olefin content of 10 to 20 weight percent, a sulfur content from 100 to 5,000 ppmw and a nitrogen content of 5 to 250 ppmw.

18. The process as claimed in claim 17 in which said feed fraction comprises a naphtha fraction having a 95 percent point of at least about 380° F.

19. The process as claimed in claim 18 in which the hydrodesulfurization is carried out at a temperature of about 500° to 800° F., a pressure of about 300 to 1000 psig, a space velocity of about 1 to 6 LHSV, and a hydrogen to hydrocarbon ratio of about 1000 to 2500 standard cubic feet of hydrogen per barrel of feed.

20. The process as claimed in claim 19 in which the octane restoring zone is conducted at a temperature of about 350° to 800° F., a pressure of about 300 to 1000 psig, a space velocity of about 1 to 6 LHSV, and a hydrogen to hydrocarbon ratio of about 100 to 2500 standard cubic feet of hydrogen per barrel of feed.

* * * * *